US005176219A

United States Patent [19]

Cole et al.

[11] Patent Number: 5,176,219

[45] Date of Patent: Jan. 5, 1993

[54] METHOD OF SEALING HOLES IN THE GROUND

[75] Inventors: Jack H. Cole; Mark P. DiStefano, both of Ponca City, Okla.; C. Michael Swindoll, Pleasanton, Calif.

[73] Assignee: Conoco Inc., Ponca City, Okla.

[21] Appl. No.: 649,400

[22] Filed: Jan. 31, 1991

[51] Int. Cl.[5] ..... E21B 33/13

[52] U.S. Cl. ..... 166/290; 166/285; 175/21; 405/240; 405/253

[58] Field of Search ..... 166/290, 285, 334; 175/21, 22, 19, 314; 405/253, 254, 240, 241, 242, 248, 257, 256

[56] References Cited

U.S. PATENT DOCUMENTS

| | | | |
|---|---|---|---|
| 779,880 | 1/1905 | Shuman | 405/242 |
| 1,459,990 | 6/1923 | Reed | 166/285 |
| 1,601,676 | 9/1926 | Burright | 166/334 X |
| 2,010,778 | 8/1935 | Stechert | 405/240 |
| 2,578,996 | 12/1951 | Endersby | 175/22 |
| 3,035,639 | 5/1962 | Brown | 166/150 |
| 3,479,829 | 11/1969 | Goodman | 166/285 X |
| 3,869,869 | 3/1975 | Pao Chen | 405/240 |
| 4,230,425 | 10/1980 | Gusev et al. | 405/240 X |
| 4,602,684 | 7/1986 | Van Wormer | 166/285 |
| 4,619,323 | 10/1986 | Gidley | 166/285 |
| 4,804,050 | 2/1989 | Kerfoot | 175/20 |
| 4,858,692 | 8/1989 | Nilsen | 166/285 |

FOREIGN PATENT DOCUMENTS

| | | | |
|---|---|---|---|
| 196955 | 5/1923 | United Kingdom | 405/240 |

*Primary Examiner*—Hoang C. Dang

[57] ABSTRACT

The invention relates to an apparatus for grouting holes in the ground to prevent a contaminated zone within the ground from contaminating other zones in the ground. In particular, the grouting apparatus is adapted to follow the hole previously formed in the ground and not detour therefrom forming a separate hole which will be grouted in lieu of the previously formed hole. When the grouting apparatus reaches the bottom of the hole, grouting material is expelled from the lower end thereof. The apparatus is thereafter withdrawn as the grouting material fills the vacated hole. The apparatus comprises a plurality of tubular segments connected together to form a pipestring. At the bottom end of the string, there is attached a tip assembly. The tip assembly comprises an outer tubular sleeve and an internal telescoping tubular sleeve. The internal tubular sleeve includes a pointed tip with a shoulder having a larger diameter than the internal tubular sleeve and at least one port along the tubular sleeve for allowing passage of the grouting material out of the string.

7 Claims, 2 Drawing Sheets

METHOD OF SEALING HOLES IN THE GROUND

FIELD OF THE INVENTION

This invention relates to sealing holes in the ground made by ground penetrating equipment to prevent underground contamination from spreading along the hole and to other uncontaminated underground strata.

BACKGROUND OF THE INVENTION

In the event that it is believed that potentially hazardous chemicals are present in the ground, an important part of the remediation task is to determine the extent of the contamination. Preferably, a thorough investigation would include a complete mapping and subsurface analyses to assess the hazards and possible solutions. For example, cone penetrometer systems are known for performing subsurface analyses and are able to provide valuable information about the underground conditions and the extent of the contamination.

The cone penetrometer is typically a self-contained system carried by a truck so as to move into and around an area acquiring data from the ground. The system basically comprises powerful hydraulic rams for driving an assembled string, having sensors at the tip and along the string, down into the earth at a controlled rate to a depth of 100 feet or more.

During its passage into the ground, the string may pass through one or more zones containing hazardous chemicals and other zones that are free of such chemicals. Once the penetrometer investigation is complete, there is concern that the hazardous chemicals may travel along the various holes formed by the penetrometer string thereby significantly spreading the contamination. Clearly, the process of investigating the contamination should not cause or accelerate the spreading of such chemicals into such chemical free zones and increase the amount of remediation work to be done.

The current practice to avoid such spreading of the contamination is to seal the hole after completion of the cone penetrometer operations by injecting grout material therein. However, during the interim between the completion of penetrometer operations and grouting process, the hole has a tendency to collapse. The collapsing of the hole does not seal the hole or alleviate the likelihood of the chemicals propagating therealong into the other underground zones or strata. Thus, there is still a need to seal the hole. As such, the practice has been to position a grouting rig, provided with an auger bit, above the hole to bore down into the earth along the course of the penetrometer hole. The hole formed by the grouting rig is then filled with grout and left to dry and seal the hole. Unfortunately, the drilled hole does not reliably follow the cone penetrometer hole. Sealing a hole that deviates from the penetrometer hole does not provide an effective seal for the penetrometer hole. Accordingly, this device has not been fully satisfactory.

It is accordingly an object of the present invention to provide a method and apparatus for sealing holes in the ground which overcomes the aforementioned drawbacks and disadvantages of the prior art.

SUMMARY OF THE INVENTION

The above and other objects of the present invention are achieved by a method and apparatus for sealing holes in the ground to substantially prevent the underground migration of fluid along the hole. The method comprises inserting a grouting string having an outside diameter generally corresponding to the diameter of the hole down into the hole wherein the grouting string has a generally pointed tip and at least one closeable port near the tip for discharging liquid grout material from the string into the bottom of the hole. The string is moved into the hole until the generally pointed tip reaches the bottom of the hole whereupon the grout port is opened to discharge liquid grout material into the hole. The string is withdrawn from the hole while liquid grout is delivered into the string until the string is out of the hole and the hole is filled with grout. The apparatus comprises a tubular pipestring having a distal end for being inserted into the hole and a pump for pumping liquid grout into the tubular pipestring. A tip assembly is connected to the distal end of the tubular pipestring and includes a generally tapered tip and closable ports near the tip to discharge the liquid grout into the hole.

BRIEF DESCRIPTION OF THE DRAWINGS

Some of the objects have been stated and other objects will appear as the description of the invention proceeds when taken in conjunction with the accompanying drawings, in which.

DETAILED DESCRIPTION OF THE PREFERRED EMBODIMENT

Figure 1:
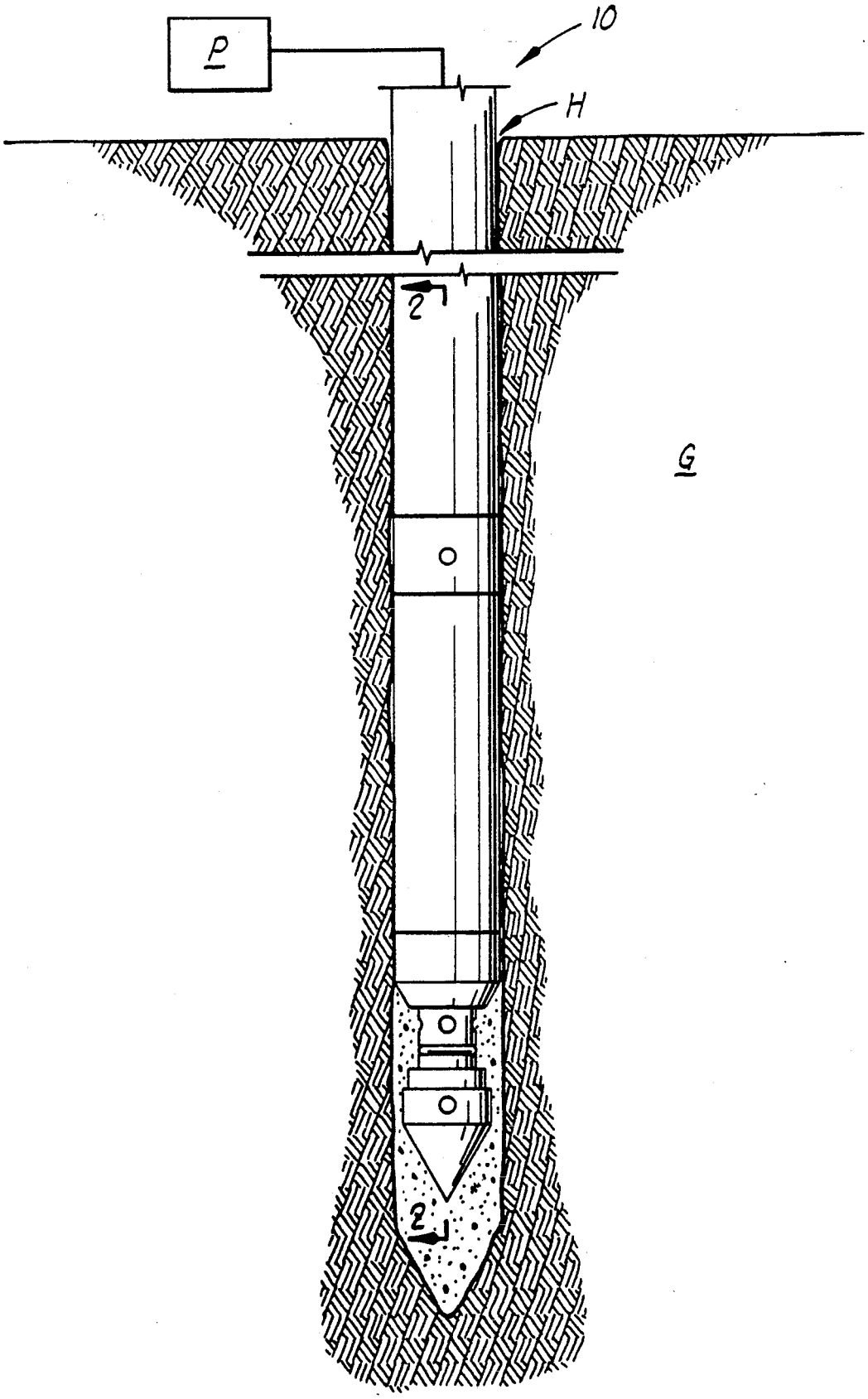
FIG. 1 is a fragmentary elevational cross section view of a hole in the ground with a grouting apparatus, embodying the features of the present invention, positioned within the hole and expelling grouting material to seal the hole.

Turning now to the drawings, there is illustrated in FIG. 1, a hole in the ground generally indicated by the letter H wherein the hole H does not include a liner or other means to prevent communication between materials in the ground and the hole H. As such, any hazardous substances in the soil which may be located in a particular zone or strata in the ground are able to easily move vertically along the hole and contaminate other zones in the ground. The hole H may be formed for a variety of reasons, such as for cone penetrometer investigation work as described above or for other subsurface work or testing. Once the need for the hole H is satisfied, it should be sealed from top to bottom to prevent such potential spreading of contamination. FIG. 1 further illustrates a preferred embodiment of a hole sealing apparatus, generally indicated by the number 10, for applying a liquid grout material into the hole H. Any suitable grout which may be pumped down into a hole in liquid form and harden to seal the hole may be utilized in this invention.

Figure 2:
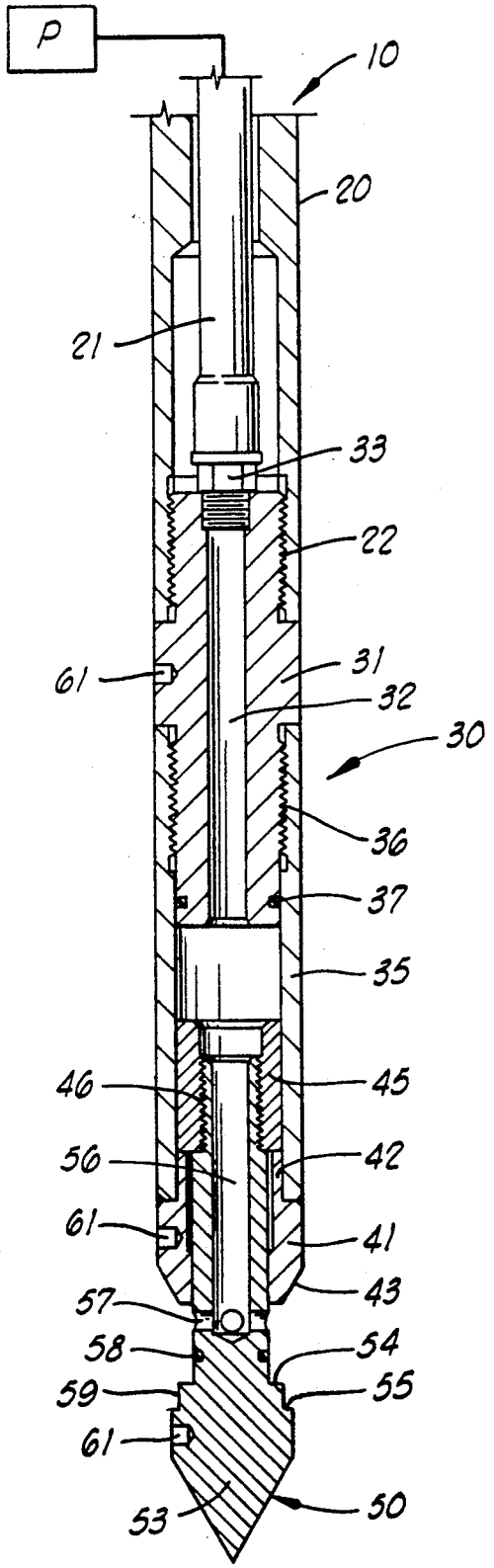
FIG. 2 is a cross section view of the grouting apparatus taken along line 2—2 in FIG. 1.
Figure 3:
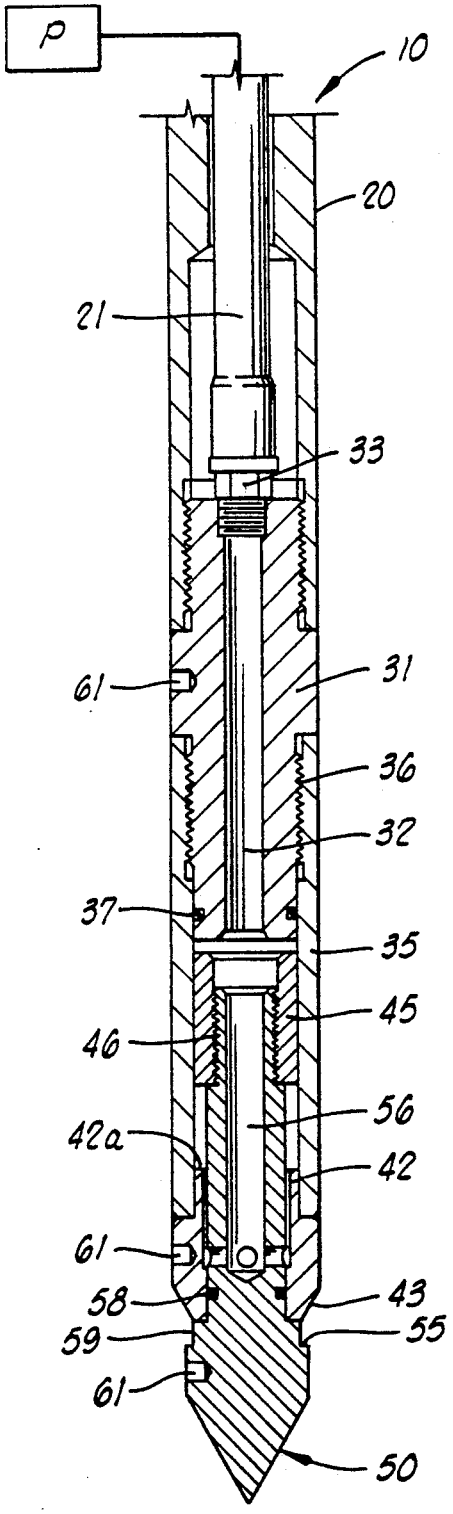
FIG. 3 is a cross section view similar to FIG. 2 but arranged for the apparatus to be pushed into the ground and follow the path of the hole.

Referring now to FIGS. 2 and 3, the apparatus 10 comprises a plurality of hollow rod sections 20 connected together end to end by suitable means such as screw threads to form a long hollow tube or pipestring. A grouting hose 21 is positioned within the tube formed by the hollow rod sections 20 for carrying grouting material from a schematically illustrated pump, indicated by the letter P, substantially the length of the pipestring to the end of the apparatus 10. A tip assembly 30 is attached to the lower end of the bottom rod section 20 and serves to lead the apparatus 10 into the hole H and then deliver the liquid grout material to the bottom of the hole H.

In particular, the tip assembly 30 includes an adapter 31 which is connected to the hollow rod section 20 at the end of the long hollow tube by screw threads 22. The adapter 31 further includes an axial passage 32 with a fitting 33 at the upper end for connecting to the grouting hose 21. An outer sleeve 3$ having an outside diameter approximately the same as the outside diameter of the hollow rod sections 20 is attached to the lower end of the adapter 31 by screw threads 36. The outer sleeve 35 is adapted to receive a cylindrical piston 45 so that the piston can reciprocate axially within the sleeve 35. A ring-like piston cap 41 is secured to the bottom end of the outer sleeve 35 and includes an axially extending annular flange 42 extending into the interior of the outer sleeve 35. The end of the annular flange 42 defines a stop 42*a*(FIG. 3) to limit the downward movement of the piston 45.

A tip member 50 is telescopically received in the lower end of the tip assembly 30 with a shaft portion 52 and a head portion 53 at the distal end thereof defining the bottom end of the apparatus 10. The shaft portion 52 extends into the ring-like piston cap 41 and is connected to the piston 45 by screw threads 46 so that as the piston 45 reciprocates in the outer sleeve 35, the tip member telescopically extends and retracts into the piston cap 41. The juncture between the shaft portion 52 and the head portion 53 forms a shoulder 54 which defines a stop against the distal end of the piston cap 41. Therefore, the length of the shaft portion 55 limits the upward movement of the piston 45 as best illustrated in FIG. 3. As such, the piston 45 and tip member 50 have a range of positions relative to the outer sleeve 35 and the piston cap 41 as illustrated in the FIGS. 2 and 3 wherein the tip member 50 is illustrated as being fully extended in FIG. 2 and fully retracted in FIG. 3.

As noted above, the tip assembly 30 serves two functions: (1) to lead the apparatus 10 into the hole; and (2) to deliver the liquid grout material into the hole. These functions are normally accomplished sequentially rather than simultaneously. In other words, the hole H is sealed by first inserting the grouting assembly 10 to the bottom of the hole H prior to the grout being ejected therefrom. Then the grout is delivered into the hole H as the apparatus is slowly withdrawn therefrom and the hole H fills with grout.

The first function of leading the apparatus 10 into the hole H is achieved by the combination of several factors which includes providing the head portion 53 of the tip member 50 with a generally tapered end so as to naturally follow the hole H down into the ground. Preferably, the tip member 50 has a conically shaped head portion 53 terminating at a relatively acutely angled point. In the illustrated embodiment, the tapered head portion 53 is similar to the shape of the tip of a cone penetrometer. Further, it is preferred that the apparatus 10 has an outside diameter which is approximately the same as the diameter as the hole H so that the axis of the apparatus 10 is generally always substantially in common with the axis of the hole H. By the peripheral surfaces of the apparatus maintaining contact with the walls of the walls of the hole H, the tapered head portion 53 is unlikely to bluntly impact the side wall walls and therefore possibly deviate from the course of hole H. At a position where the hole H has collapsed, the alignment with the remainder of the hole H and the generally tapered tip are likely to "find" the remainder of the hole H without substantially deviating as will be discussed further below.

Once the tip assembly 30 has reached the bottom of the hole H, the grouting apparatus 10 is shifted to its second function of delivering the liquid grout material therein. To accomplish this function, the apparatus 10 is provided with a grout hose 21 as discussed above for delivering grout from a pump to the tip assembly 30. The tip assembly 30 includes an axial channel connected with the grout hose 21 to carry the grout to the tip member 50. The axial channel primarily includes the axial passage 32 but also includes the interior of the outer sleeve 35 and the interior of the piston 45. An O-ring seal 37 prevents pressurized grout from leaking through the threads 36.

The shaft portion 52 of the tip member 50 further includes an axial bore 56 which terminates near but preferably above the shoulder 54. A plurality of radial ports 57 are provided through the outer wall of the shaft portion 52 to intersect with the axial bore 56 near the bottom thereof. Thus the grout material passing down through the axial channel in the tip assembly 30 moves through the axial bore 56 and exits through the ports 57.

The grout passage in the tip assembly 30, or more particularly the ports 57 are adapted to be closed to prevent soil or material from backing up into the tip assembly 30 while the apparatus 10 is being inserted into the hole H. The closing of the grout passage is accomplished by the occlusion of the ports 57. As illustrated in FIG. 3, the ports 57 are spaced from the shoulder 54 along the shaft portion 52 so that the ports 57 are disposed within the outer sleeve 35 or the piston cap 41 when the tip member 50 is retracted. A seal, such as an O-ring 58, is positioned about the shaft portion 52 between the radial ports 57 and the shoulder 54 to seal the space between the piston cap 41 and the tip member 50 when the tip member is retracted. Thus, the grout path through the tip assembly 30 is opened and closed by reciprocation of the piston 45.

It should be noted that the head portion 53 has a smaller outside diameter than the outside diameter of the remainder of the apparatus 10 and more particularly smaller than the diameter of the hole H. The reason is to allow the liquid grout to pass around the head portion 53 to get to the bottom of the hole H as illustrated in FIG. 1. As such, the piston cap 41 includes a chamfered edge 43 adjacent the distal end thereof. The chamfered edge reduces drag as the apparatus 10 moves down the hole H and works against the side walls of the hole H to maintain the apparatus centered in the hole H.

In the preferred embodiment, the grouting apparatus 10 is supported above the ground by the same rig that was used to form the hole H. More particularly, the same rig that was used to form the hole H is used to insert the grouting apparatus 10 prior to the rig being removed from the site after the hole was formed so as to minimize the opportunity for the hole H to collapse. Otherwise, it is more difficult to insert the grouting apparatus to the bottom of a collapsed hole and it increases the opportunity for the apparatus to deviate form the hole H, thereby forming a new hole.

There are other advantages to using the same equipment that formed the hole H. For example, to provide a different rig to insert the grouting apparatus 10 into the hole H requires tedious adjustments to the rig to provide accurate alignment with the hole H. The equipment that formed the hole H required no such alignment. Further, the process of removing the original rig and installing a second rig to grout the hole may cause the hole to collapse by vibration or other activity at the top of the hole. Thus, it is preferred that the operating rig be used to seal the hole.

As noted above, it is also preferred that the outside diameter of the rod sections 20 have approximately the same diameter as the hole H. Therefore, the grouting apparatus 10 will fit neatly into the hole H and be less likely to get skewed in the hole H. It should be understood, however, that the hole H is unlikely to be uniformly straight throughout the length of the hole, but rather has bends and turns. Thus, the contact along the sides of the grouting apparatus keeps the generally tapered head portion 53 moving through the center of the hole H.

In the situation of the cone penetrometer, the hole is formed by a conically tipped string which is pushed by hydraulic rams into the ground. As such it is sensitive to the resistance and density of the soil, thus the hole then tends to meander. The meandering course of the hole is particularly notable in comparison to hole formed by a drill string which includes a rotary drill bit at the end thereof. Thus, by providing the apparatus 10 with an outside diameter which provides contact with the sides of the hole on all sides of the apparatus 10, the generally tapered head portion 53 will be better aligned with the hole H and better able to follow the meandering path of the hole H.

It should further be noted that the differences between the "straightness" of the holes made by a drill string and a string with a pointed tip pushed into the ground such as a cone penetrometer are substantial. This as noted above is one of the causes of the dissatisfaction with the prior art method described in the Background of the Invention above. Using a rotary drill string to chase through the meandering hole formed by a cone penetrometer, particularly a hole that has collapsed, is unlikely to be able to provide satisfactory results. While the rotary drill string will somewhat follow the path of least resistance, it is not as sensitive to the density and resistance and will bore straight on through a formation that would cause a substantial deviation in the path of the cone penetrometer. With the present invention, the generally tapered tip follows the path of least resistance which is, more likely, quite clearly the path of the hole H.

At positions where the hole has collapsed, there is the possibility that the apparatus 10 will deviate from the hole but the same forces that guided the penetrometer will still be present to guide the apparatus 10 as well as the deformation in the soil caused by the penetrometer. In other words, the penetrometer compresses soil out of its way when forming the hole H and the compressed soil in the side walls therefore have a higher density then the soil in the adjacent unaffected soil. The apparatus 10 reacts to the higher density soil when it deviates from the hole and moves back to low resistance hole H. However, when the hole collapses, soil which formed the walls falls into the hole. While the collapse can take many forms, the apparatus 10 will essentially form a new hole in or adjacent to the same location of the portion of the hole that collapsed. The path of least resistance will more than likely remain somewhere near the former hole or within the section of compressed soil formed by the penetrometer when making the hole H. If there is an uncollapsed portion below the collapsed portion, the apparatus is more likely to be within the section of compressed soil surrounding the former hole and emerge within the continuation of the hole.

This is particularly important if the former hole had some deviations in the collapsed portions, because the present invention is more sensitive to the conditions of the soil and would be more likely to follow the compressed soil sections and therefore the deviation in the path. Furthermore, whatever caused the deviation in the first hole would also tend to cause the apparatus 10 to deviate in substantially the same manner. Accordingly, the apparatus 10 is well suited for reaching down into existent holes for grouting the same whether the holes were formed by drilling equipment or otherwise.

In operation, the grouting hose 21 is prethreaded through a predetermined number of individual rod sections 20 and connected to the tip assembly 30. The other end of the grouting hose 21 is connected to the grout pump P. The grout pump P is then activated to prime the system and expel air or other fluids therefrom. Once the grout material begins to emerge from the ports 57, the tip member 50 is pushed into its retracted position in the tip assembly 30. The grouting apparatus 10 is then inserted into the hole H and pushed until it reaches the bottom. There are a number of known methods of developing downward pressure on a string to push the same in the ground. In the example of sealing a cone penetrometer hole, the rig would likely have one or more hydraulic rams to push the apparatus 10 into the hole H.

When the tip member 50 reaches the bottom of the hole H, the pump P is again activated to deliver grout material to the hole H. The pressure created by the pump P causes the tip member 50 to telescopically extend from the piston cup 41 to open the ports 57. The grouting apparatus 10 is then slowly withdrawn from the hole H while grout is simultaneously pumped into the hole H to permit the grout to settle therein. The liquid grout is pumped through the hose 21 by the pump P in a metered fashion to assure that the hole H is completely filled with grout. It should be noted that a second ledge 55 is machined into tip 53 resulting in a reduced diameter 59. This combination of ledge 55 and reduced diameter 59 act somewhat like the barbs of an arrow head to provide frictional resistance between the tip and the walls of the hole H. Such resistance helps extend the tip 53 as the apparatus 10 is withdrawn.

When the hole H is completely filled, the apparatus 10 is removed from the hole H for cleaning while the grout sets up and hardens to thereby seal the hole H. The apparatus 10 is flushed with water or other solvent depending on the type of grout material being used. The flushing cleans the hose 21 and substantially all the tip assembly 30. However, the tip assembly 30 should be disassembled for more complete cleaning to remove any residual grout before it hardens and interferes with the movement of the tip member 50. Several wrench holes 61 are provided in the tip assembly 30 for use by a spanner wrench or other special tools to screw or unscrew the threaded connections in the tip assembly 30 and thereby make the assembly and disassembly easier.

The apparatus may further be useful for injecting other fluids and mixtures other than grout into the hole. While grouting is typically a continuous delivery of grout, the injected fluid may alternatively be intermittantently injected to test, for example, the permiablitlty or porosity of the soil. In another process, the apparatus may be used to withdraw fluids from the ground such as when taking a liquid or gas sample. Quite clearly, the apparatus has further utility than simply as a grouting device.

In the drawings and specification there has been set forth a preferred embodiment of the invention. Although specific terms are employed in the description, they are used in a generic and descriptive sense only and not for purposes of limitation. The scope of the invention is defined in the claims.

We claim:

1. A method for sealing holes in the ground to substantially prevent the underground migration of fluid along the hole, the method comprising:

pre-threading a flexible tube through individual sections of grouting string prior to inserting the grouting string into the ground;

inserting the grouting string having an outside diameter generally corresponding to the diameter of the hole down into the hole wherein the grouting string has a generally pointed tip and at least one closeable port near the tip for discharging liquid grout material from the string into the bottom of the hole;

moving the string into the hole until the generally pointed tip reaches the bottom of the hole;

opening the grout port to discharge liquid grout material into the hole; and withdrawing the string from the hole while delivering liquid grout into the string until the spring is out of the hole and the hole is filled with grout.

2. The method according to claim 1 wherein the step of inserting the grouting string further comprises inserting the string into the hole prior to removing the rig that removed the hole from its location above the hole.

3. The method according to claim 2 wherein the step of inserting grouting string into the hole comprises pressing the string downward into the hole using the rig that formed the hole.

4. The method according to claim 3, further comprising the steps of pumping liquid grout through the string prior to inserting the string into the hole.

5. The method according to claim 4 wherein the grout port is closed by retracting a telescopic member at the tip of the string and wherein the step of opening the grout port comprises pumping liquid into the string to increase the pressure thereto the cause the telescopic member to extend outwardly from the tip of the string.

6. The method according to claim 5 wherein the step of opening the grout port further comprises lifting the grout string to frictionally pull on the telescopic member.

7. A method for sealing holes in the ground to substantially prevent the underground migration of fluid along the hole, the method comprising:

forming a hole in the ground with a first rod string for a predetermined activity;

withdrawing the first rod string from the hole;

after the predetermined activity of the hole is completed, inserting a grouting string having an outside diameter generally corresponding to the diameter of the hole down into the hole wherein the grouting string has a generally pointed tip and at least one closeable port near the tip for discharging liquid grout material from the string into the bottom of the hole;

moving the string into the hole until the generally pointed tip reachers the bottom of the hole;

opening the grout port to discharge liquid grout material into the hole; and withdrawing the string from the hole while delivering liquid grout material into the string until the string is out of the hole and the hole is filled with grout.

* * * * *